United States Patent [19]

Ford

[11] Patent Number: 4,899,556

[45] Date of Patent: Feb. 13, 1990

[54] JEWELRY WITH INTERCHANGEABLE ORNAMENTATION

[76] Inventor: Donna M. Ford, Box 4665, New River Stage, Phoenix, Ariz. 85029

[21] Appl. No.: 252,588

[22] Filed: Oct. 3, 1988

Related U.S. Application Data

[62] Division of Ser. No. 55,593, May 29, 1987, Pat. No. 4,793,155.

[51] Int. Cl.[4] ..... A44C 7/00; A44B 1/12

[52] U.S. Cl. ..... 63/14.1; 24/113 R; 24/104; 63/29.1

[58] Field of Search ..... 63/12, 29.1; 24/113 R, 24/92, 94, 104, 106

[56] References Cited

U.S. PATENT DOCUMENTS

| | | | |
|---|---|---|---|
| 306,487 | 10/1884 | Hemer | 24/104 |
| 785,261 | 3/1905 | Lowery | 24/104 |
| 1,160,591 | 11/1915 | Gerber | 24/113 R |
| 2,602,975 | 7/1952 | Wolfe | 24/113 R |
| 2,825,951 | 3/1958 | Chaves | 24/113 R X |
| 3,412,578 | 11/1968 | Rosencrans | 63/29.1 |

FOREIGN PATENT DOCUMENTS

| | | | |
|---|---|---|---|
| 68696 | 12/1944 | Norway | 24/113 R |

*Primary Examiner*—Richard J. Johnson

*Attorney, Agent, or Firm*—Jordan M. Meschkow; Don J. Flickinger; Lowell W. Gresham

[57] ABSTRACT

A removable member, having a front surface for receiving a flexible sheet of ornamental material thereover, is attachably engageable with a backing member. A peripheral edge of the sheet is gripped and held between the engaged members. The backing member carries a post, clip, pin or other device for attachment to a selected substrate such as the human body or the clothing. The movable member is held in snap engagement with the backing member for convenient separation and changeability of the ornamental sheet material.

8 Claims, 3 Drawing Sheets

JEWELRY WITH INTERCHANGEABLE ORNAMENTATION

CROSS REFERENCE TO RELATED APPLICATIONS

The instant application is a divisional of copending application Ser. No. 055,593, filed 29 May 1987, now Pat. No. 4,793,155.

BACKGROUND OF THE INVENTION

1. Field of the Invention

This invention relates to jewelry.

More particularly, the present invention relates to jewelry, of the type normally having a post, clasp or other means for attachment to the body or to clothing.

In a further and more specific aspect of the instant invention concerns a jewelry device, such as an earring or brooch, having selectively interchangeable surface ornamentation.

2. The Prior Art

The desirability of coordinating the color of accessories with that of the primary clothing is well established. Both matching and contrasting are considered forms of coordinating. For example, white shoes and a white purse may be selected to be worn with a white dress. Alternately, the white dress may be complimented with red accessories.

Color coordination has long been a concern of button manufactures Buttons are commercially produced in a seemingly endless array of colors. Numerous sizes and shapes are also available. Further accommodation, especially for the home seamstress, is provided by a type of button especially adapted to have a cloth swatch applied over the face thereof. The cloth may represent scrap material from which the item of clothing was made or, a deliberately chosen alternative.

The jewelry art, however, has not provided the flexibility and convenience associated with the button art. Manufacturers have provided various items of jewelry, such as pins, brooches and earrings, in a variety of styles, colors, and materials. Since the items are produced in a fixed form, an alternate accessory requires the financial investment of a subsequent purchase Even so, the selection is limited to the option and discretion of the manufacturer.

On an exceedingly limited basis, the prior art has attempted to provide the jewelry wearer with optional alternatives. Exemplary are finger rings with interchangeable settings. Also noted are earrings and pins with changeable elements. Nevertheless, the selection is limited to the discretion of the manufacturer and the user is required to make additional purchase.

The teachings of the button art are not adaptable as a remedy for the deficiencies of the jewelry art. A button represents a permanent fixture to an item of clothing. Accordingly, the art teaches that the cloth covering is affixed in a manner which is considered to be permanent. The jewelry art demands that the ornamentation be quickly and conveniently changed to accommodate wearing a single item with often repeated changes of clothes. Further, the procedure must be achievable by persons otherwise lacking in skill and manual dexterity.

It would be highly advantageous, therefore, to remedy the foregoing and other deficiencies inherent in the prior art.

SUMMARY OF THE INVENTION

In accordance with the foregoing, it is an object of the present invention to provide improvements in jewelry with interchangeable ornamentation.

Another object of the invention is the provision of an item of jewelry in which the selection of ornamentation is entirely within the discretion of the user.

And another object of the invention is to provide improved means for detachable securement of selected ornamental sheet material to a jewelry item.

Still another object of this invention is the provision of a jewelry device in which the ornamentation can be quickly and easily changed without prerequisite skills.

Yet another object of the invention is to provide improvements which are adaptable to various jewelry items such as brooches and earrings.

And still another object of the instant invention is the provision of means whereby the ornamentation may be selected from a virtually limitless selection.

And a further object of the invention is to provide a jewelry device which is unencumbered and comfortable to wear.

Still a further object of the immediate invention is the provision of a jewelry device having improved means for coupling the ornamentation holding member to the backing member.

Yet a further object of the invention is to provide an item of jewelry which may be fabricated by standard techniques of various selected materials.

And yet a further object of the invention is the provision of a device according to the foregoing which is relatively simple and inexpensive.

Briefly, to achieve the desired objects of the instant invention in accordance with a preferred embodiment thereof, first provided is a backing member including a front side, a rear side and a forwardly directed contact surface. Next provided is a removable member including a front surface for receiving a selected ornamental flexible sheet member thereover and further including a complemental contact surface opposing the contact surface of the backing member for receiving a peripheral portion of the sheet member therebetween. Coupling means are provided for detachably affixing the removable member to the backing member and compressively gripping the sheet member between the contact surfaces. The device is detachably securable to a selected substrate by means of attachment means projecting from the rear side of the backing member.

More specifically, the coupling means may assume the form of a male/female engagement pair having one of the elements carried by the backing member and the complemental element carried by the removable member. Manually manipulative release means are provided for selectively disengaging the element from the complemental element which would normally be held in engagement by biasing means. Preferably, the release means includes a lever having a terminal portion residing in juxtaposition with the rear side of the backing member. To further enhance the coupling, the female element may be provided with an inwardly directed engagement element which is received within a complemental engagement element carried by the male element. Also contemplated are alignment means which may assume the form of a socket formed into the backing member for receiving a projection extending from the removable member.

In accordance with an alternately preferred embodiment of the instant invention, the removable member is provided with engagement means for engaging a peripheral portion of the sheet member extending over the front surface thereof and which are detachably connectable with forwardly directed engagement receiving means carried by the backing member. The engagement means are received in snap engagement within the engagement receiving means. In a specific configuration, the engagement means may include a plurality of generally radially outwardly extending flexible fingers which are frictionally received within a continuous sidewall functioning as the engagement receiving means.

In accordance with yet another alternately preferred embodiment of the instant invention, the backing member is provided with forwardly directed engagement receiving means which are detachably connectable with engagement means extending rearwardly from the removable member. The engagement means are received in snap engagement with the engagement receiving means. More specifically, the engagement means may include a plurality of generally radially outwardly extending flexible fingers which are frictionally received within a continuous sidewall functioning as the engagement receiving means. Further a peripheral portion of the sheet member extending over the front surface of the removable member is compressively held between opposed annular contact surfaces carried by each of the members.

BRIEF DESCRIPTION OF THE DRAWINGS

The foregoing and further and more specific objects and advantages of the instant invention will readily occur to those skilled in the art from the following detailed description of preferred embodiments thereof taken in conjunction with the drawings in which.

DETAILED DESCRIPTION OF THE PREFERRED EMBODIMENTS

Figure 1:
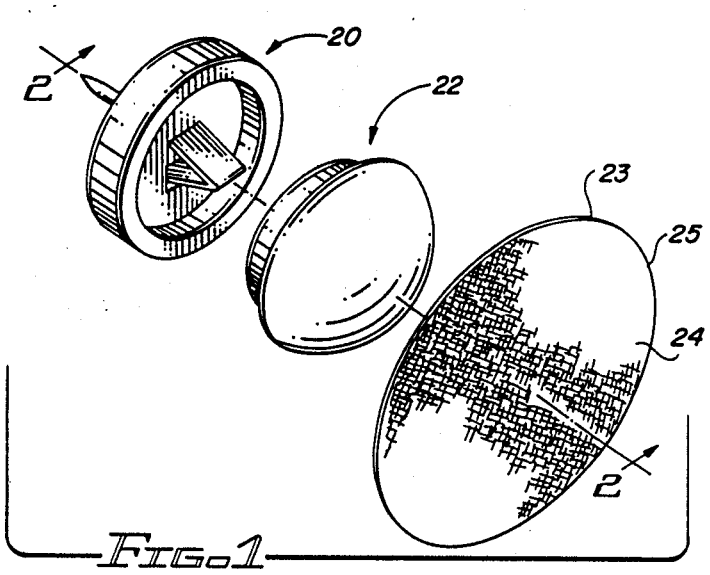
FIG. 1 is an exploded perspective view of a jewelry device embodying the principles of the instant invention.

Turning now to the drawings, in which like reference characters indicate corresponding elements throughout the several views, attention is first directed to FIG. 1 which illustrates a jewelry device of the instant invention including a backing member generally designated by the reference character 20 and a removable member generally designated by the reference character 22. Also illustrated is deformable or flexible sheet member 23 having decorative surface 24 and peripheral edge 25. Functioning as the ornamental cover for removable member 22, sheet member 23 may be of any selected flexible or deformable material such as cloth, plastic or metal foil. The material may be especially purchased for the purpose or may be scrap from a prior project such as the construction of an item of clothing. Where it is desired that the jewelry item exactly match a prior existing item of clothing, member 23 may be cut from additional material found in a hem or seam.

Figure 2:
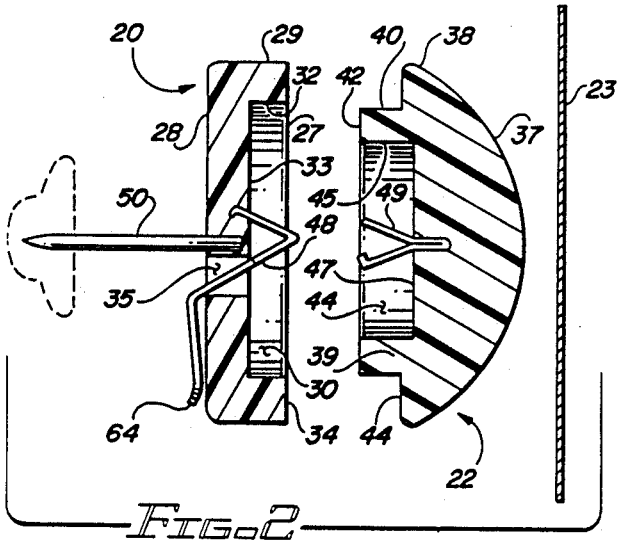
FIG. 2 is a vertical sectional view, on an enlarged scale, taken along the line 2—2 of FIG. 1.

With further reference to FIG. 2, it is seen that backing member 20 includes front side 27, rear side 28 and peripheral edge 29. Socket 30 extending inwardly from front side 27 is defined by preferably cylindrical sidewall 32 and preferably planar endwall 33. Annular contact surface 34 resides on front side 27 intermediate socket 30 and peripheral edge 29. Opening 35 communicates between socket 30 and rear side 28.

Removable member 23 includes front surface 37, peripheral edge 38 and rearwardly extending projection 39 having external surface 40 and rear surface 42., Annular contact surface 43 resides intermediate edge 38 and surface 40. Recess 44 defined by sidewall 45 and endwall 47 is formed inwardly from rear surface 42.

An element 48 of a male/female engagement pair is carried by backing member 20. A complemental element 49 of the male/female engagement pair is carried by removable member 23. Further description of the engagement pair will be made presently. Post 50, such as the post normally associated with earrings of the type especially devised for wearers having pierced ears, projects from the rear side 28 of backing member 20. As will be appreciated by those skilled in the art, post 50 is intended to be representative of pins, clips and other attachment means for detachably securing the immediate jewelry device to a selected substrate such as the body or an item of clothing.

Figure 3:
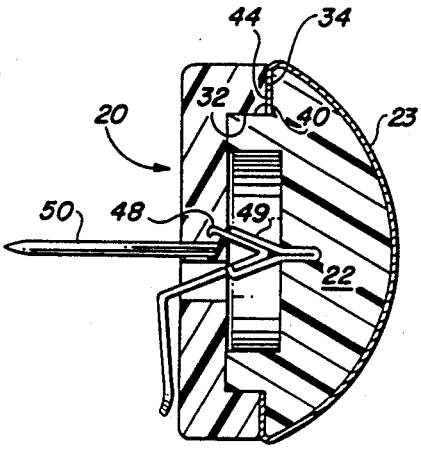
FIG. 3 is a view generally corresponding to the view of FIG. 2 and illustrating the device as it would appear when assembled.

The previously described device is readily assembled as will now be described in connection with FIG. 3. Sheet member 23 is first applied to removable member 22. With finger pressure, member 23 is placed over surface 37 and folded along edge 38 such that a peripheral portion resides adjacent surface 44. The assembly is then engaged with backing member 20 During the engagement, entrance of projection 39 into socket 30 function as alignment means as external surface 40 is closely received within internal sidewall 32. The insertion is continued until the elements of the male/female engagement pair couple in snap engagement. With removable member 22 coupled with backing member 20, surfaces 44 and 34 function as contact surface and complemental contact surface, respectively, for compressively gripping the peripheral portion of member 23 therebetween.

Figure 4:
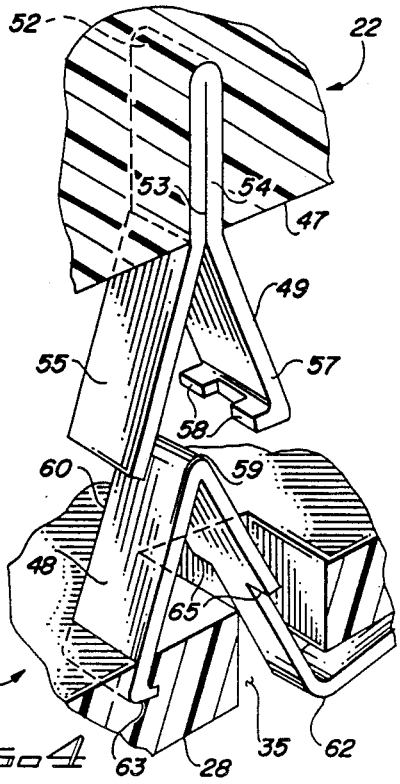
FIG. 4 is an enlarged fragmentary perspective view of a preferred coupling means incorporated into the embodiment of FIG. 1.

Further details of the coupling between removable member 22 and backing member 20, and the uncoupling of same, will be appreciated from the following description of a preferred male/female engagement pair as seen in FIG. 4. For purposes of discussion, element 48 comprises the male element while complemental element 49 comprises the female element. In accordance with the immediately preferred embodiment thereof, female element 49 is fabricated of an elongate thin metal member folded along crease 52 to form initial portions 53 and 54 which lie in juxtaposition and are secured within removable member 22. Finger portions 55 and 57 extending from initial portions 53 and 54, respectively, diverge within recess 44. A pair of inwardly directed tabs 58 are carried at the free end of finger portion 57.

Male element 48, in general similarity to female element 49, may also be fabricated from an elongate thin metallic member. A flexible material, such as spring steel or tempered brass, is recommended. Element 48 is folded along transverse crease 59 to form attachment portion 60 and a lever portion 62. End 63, the end of attachment portion 60 and of the entire element, is rigidly affixed to backing member 20. Lever portion 62 extends through opening 35 and terminates with a free end 64 (seen in FIG. 2) residing externally of backing member 20. At an intermediate location, lever portion 62 is narrowed to be received between the tabs 58 and to provide a pair of shoulders 65.

Figure 5A:
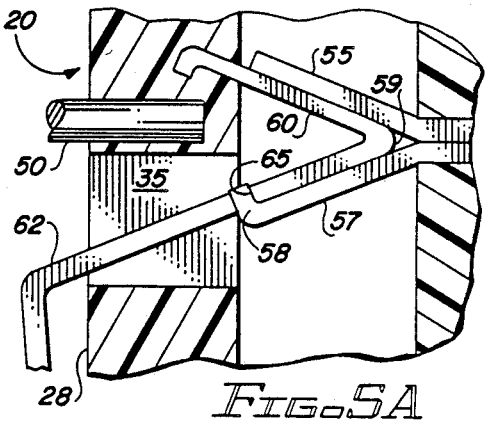
FIG. 5A is a side elevation view of the coupling means of FIG. 4 as it would appear in the engaged configuration.

With further reference to FIG. 5A, it is seen that attachment portion 60 and lever portion 62 converge within socket 30 to crease 59. The angle of convergence of portions 60 and 62 generally correspond to the angle of divergence of portions 55 and 57. Accordingly, element 48 is matingly received within complemental element 49. As the members 20 and 22 are moved together into the engaged position, lever portion 62 will move inwardly in response to the pressure exerted thereon by tabs 58. Engagement between the members is completed when tabs 58 are received by the shoulders 65. In the engaged or coupled position, sheet member 23 is firmly gripped and held between backing member 20 and removable member 22.

Figure 5B:
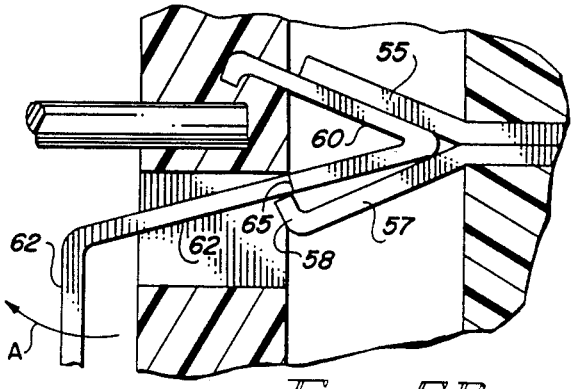
FIG. 5B is a view generally corresponding to the view of FIG. 5A and specifically illustrating the coupling means a it would appear in the release position.

The terminal portion 67 of element 48 adjacent end 64 and residing in juxtaposition with the rear side 28 of backing member 20, functions as a manually manipulative lever. As the lever 67 is moved in the direction of arrowed line A as seen in FIG. 5B, the entire lever portion 62 reacts as release means to displace shoulders 65 from tabs 58 whereby the element 48 and the complemental element 49 are brought into a disengagement position. The natural resiliency of the material of construction of element 48 provide an inherent biasing means to normally maintain the shoulders 65 in engagement with the tabs 58. In the release position, removable member 22 is readily separable from backing member 20 for a selective change of sheet member 23

Figure 6:
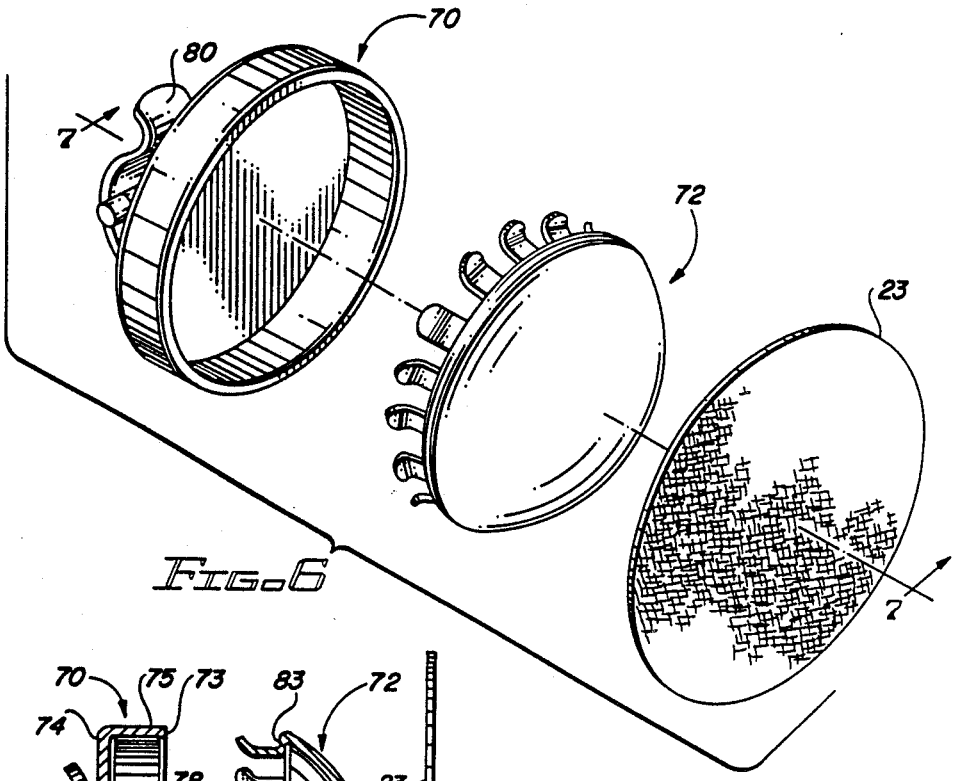
FIG. 6 is an exploded perspective of an alternate jewelry device constructed in accordance with the teachings of the instant invention.

Referring now to FIG. 6 there is seen an alternate embodiment of the invention which, incorporating the teachings of the instant invention, includes a backing member and a removable member generally designated by the reference characters 70 and 72, respectively. The members cooperate to removably hold and display previously described ornamental flexible sheet member 23

Figure 7:
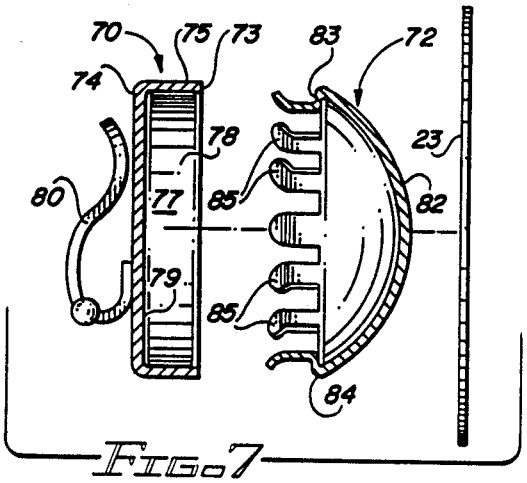
FIG. 7 is a vertical sectional view, on an enlarged scale, taken along the line 7—7 of FIG. 6.

Backing member 70, a generally cup-shaped member as seen with further reference to FIG. 7, includes front side 73 side 74 and outer peripheral edge 75. Recess 77 formed into member 70 from front side 73 is defined by continuous sidewall 78 and endwall 79 Attachment means, herein illustrated as clip 80, projects from the rear side 74 Backing member 70 is readily stamped from a selected metal or molded of a suitable plastic.

Removable member 72 includes front side 82, rear side 83 peripheral edge 84. A plurality of spaced apart finger 85, preferably arranged in a continuous annular row, project rearwardly from rear side 83. Preferably each finger 85 is deformed to extend generally radially outward.

Figure 8:
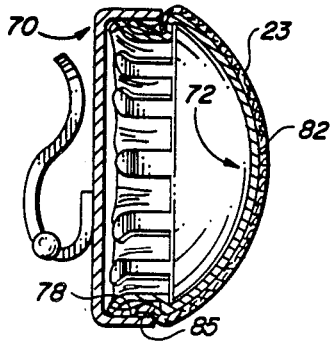
FIG. 8 is a view generally corresponding to the view of FIG. 7 and showing the device in the assembled configuration.
Figure 9:
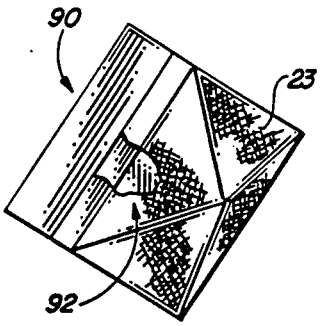
FIG. 9 is a perspective view of yet another embodiment of the instant invention as it would appear when assembled.

The assembly of the immediate embodiment is generally analogous to the assembly of the previously described ' embodiment. Front side 82 functions as a surface for receiving sheet member 23 thereover, as specifically illustrated in FIG. 8. The peripheral portion of sheet member 23 is engaged over the ends of the several fingers 85. The plurality of fingers 85, which function as engagement means, are received within recess 77 which functions as a forwardly directed engagement receiving means Each of the several fingers, which are preferably flexible, are received in frictional engagement with the contact surface provided by sidewall 78. The front side 73 of backing member 70, an annular surface residing between peripheral edge 75 and recess 77, and the rear side 83 of removable member 72 residing intermediate peripheral edge 84 and the arrangement of fingers 85, functions as abutment surfaces to limit the insertion of fingers 85 into recess 77. The annular surfaces also function to compressively grip sheet member 23 therebetween. By reverse procedure, removable member 72 is readily separated from backing member 82 whereby ornamental sheet member 23 may be readily replaced FIG. 9 illustrates yet another embodiment of the invention including backing member 90 and removable member 92. In further analogy to the previously described embodiments, ornamental sheet member 23 extends over the face surface of removable member 92. Movable member 92 is couplable with backing member 90 in accordance with the teachings of the instant invention as previously described in detail.

Figure 10:
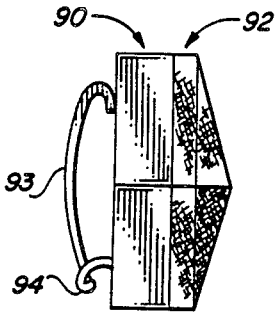
FIG. 10 is a side elevation view of the embodiment of FIG. 9.

The front surfaces of removable members 22 and 72 were chosen for purposes of illustration as being generally rounded or dome shaped. FIG. 9 is set forth to illustrate, in part, that the device of the instant invention may assume other configurations. Herein, the peripheral edges of the backing member and of the removable member have the general appearance of a diamond The front surface of the removable member is generally pyramidal. Other shapes such as standard geometric forms and free forms will readily occur to those skilled in the art. As further modification, as seen in FIG. 10, alternate attachment means in the form of a pin 93 and clasp 94 are carried by backing member 90.

Figure 11:
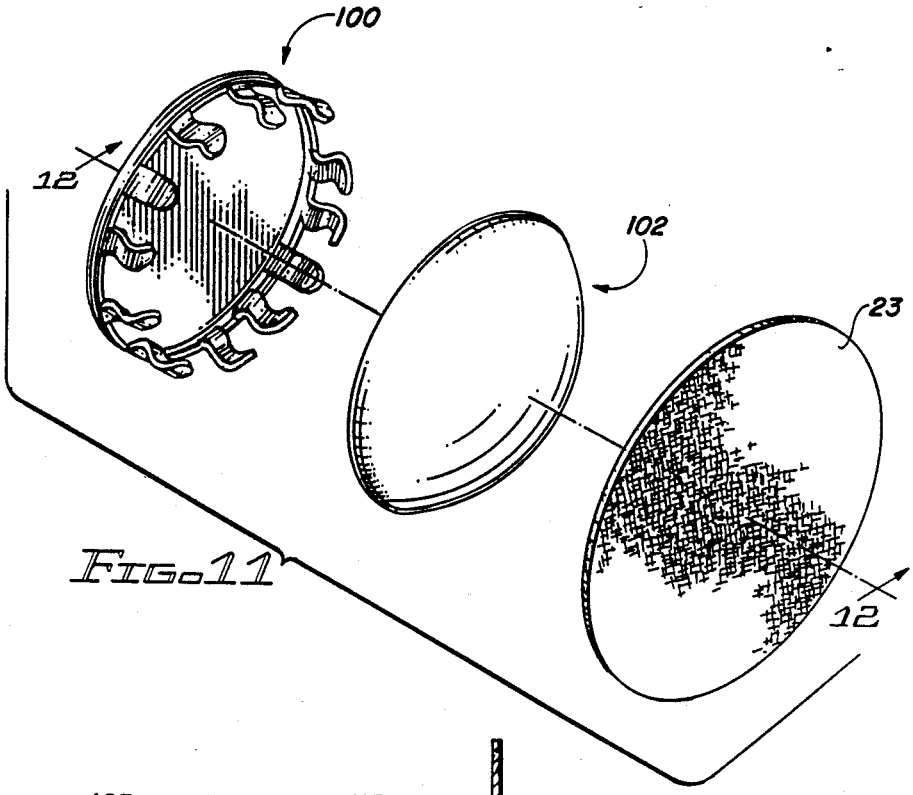
FIG. 11 is an exploded perspective view of yet another alternate jewelry device of the instant invention.

With reference to FIG. 11 there is seen yet another embodiment of the invention including a backing member generally designated by the reference character 100 and a removable member generally designated by the reference character 102. Analogous to the previously described embodiments, the members are detachably engageable and include means for removably holding and displaying the previously described ornamental flexible sheet member 23.

Figure 12:
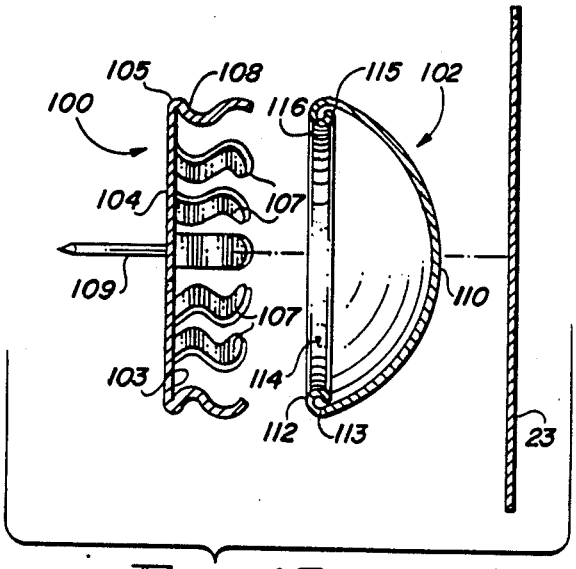
FIG. 12 is a vertical sectional view taken along the lines 12—12 of FIG. 11.

Backing member 100, a generally planar member as seen with further reference to FIG. 12, includes front side 103, rear side 104 and outer peripheral edge 105. Engagement means, herein illustrated as a plurality of spaced apart forwardly directed flexible fingers 107, project from face side 103. A generally annular contact surface 108 resides intermediate peripheral edge 105 and the several fingers 107. A post 109, representative of typical attachment means, projects from rear side 104.

Removable member 102 includes front side 110, rear side 112 and peripheral edge 113. Preferably, removable member 102 is in the form of a thin-walled hollow structure having opening 114 formed into the rear side 112 thereof. Opening 114 is circumscribed by inwardly directed toroidal bead 115 having sidewall 116 which extends about opening 114.

Figure 13:
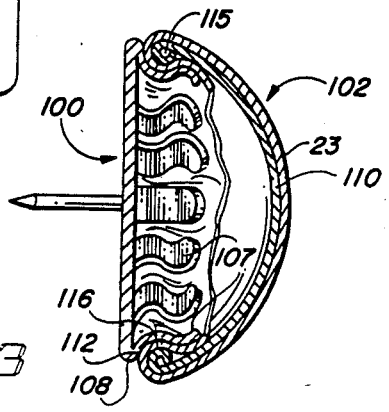
FIG. 13 is a view generally corresponding to the view of 12 and showing the device in the assembled configuration.

The assembly of the immediate embodiment is generally analogous to the assembly of the previously described embodiments. Front surface 110 of removable member 102 functions, as best illustrated in FIG. 13, as a surface for receiving sheet member 23 thereover. During the initial assembly, the peripheral portion of sheet member 23 is engaged about bead 115 to terminate within the hollow member 102. Subsequently, the several fingers 107 are inserted into removable member 102 through opening 114. The insertion is continued until the surface 108 of backing member 100 abuts the surface 112 of removable member 102. The engagement of the several fingers 107 with the surface 116 serves to hold the members in snap engagement. During the engagement the several fingers 107 will engage the peripheral portion of member 23 to stretch and tighten the same over surface 110. After final engagement, the surfaces 108 and 112 function as opposed contact surfaces to compressively hold the peripheral portion of the member 23 therebetween. The foregoing procedure is reversed for convenient separation of the members and replacement of the ornamental sheet member.

Various other modifications and variations to the embodiments herein chosen for purposes of illustration will readily occur to those skilled in the art. To the extent that such modifications and variations do not depart from the spirit of the invention, they are intended to be included within the scope thereof which is limited only be a fair assessment of the following claims.

Having fully described and disclosed the instant invention, and alternately preferred embodiments thereof, in such clear and concise terms as to enable those skilled in the art to understand and practice the same, the invention claimed is:

1. A jewelry device for removably holding and displaying a selected ornamental flexible sheet member and for detachable securement to a selected substrate, said jewelry device comprising:

(a) a backing member including
  (i) a front side;
  (ii) a rear side; and
  (iii) a forwardly directed contact surface;
(b) a removable member including
  (i) a front surface for receiving said sheet member thereover; and
  (ii) a complemental contact surface opposing said contact surface for receiving a peripheral portion of said sheet member therebetween;
(c) coupling means for detachably affixing said removable member to said backing member and compressively gripping said sheet member between said contact surfaces and further including:
  (i) a female member carried by said removable member and having an inwardly directed engagement element;
  (ii) a male member carried by said backing member having a complemental engagement element for receiving said engagement element in snap engagement when said male member is inserted into said female member; and
  (iii) release means for selectively disengaging said complemental engagement element from said engagement element; and
(d) attachment means projecting from the rear side of said backing member for detachably securing said jewelry device to said substrate; and
(e) alignment means whereby said removable member is received by said backing member in axial alignment.

2. The jewelry device of claim 1, wherein said alignment means includes:

a. a socket formed into the front side of said backing member; and
b. a projection extending from said removable member and locationally receivable within said socket.

3. The jewelry device of claim 2, wherein:

a. said socket includes a generally cylindrical internal surface; and
b. said projection includes an external surface matingly receivable within said internal surface.

4. The jewelry device of claim 1, wherein said coupling means includes:

a. a female member carried by said removable member and having an inwardly directed engagement element; and
b. a male member carried by said backing member and including
  i. a complemental engagement element for receiving said engagement element in snap engagement when said male member is inserted into said female member; and
  ii. release means for selectively disengaging said complemental engagement element from said engagement element.

5. The jewelry device of claim 1, wherein:

a. said backing member includes
  i. a recess formed into the front side thereof, and
  ii. an opening communicating between the recess and the rear side; and
b. said male member includes an elongate flexible member extending through said opening and having a fixed end within said recess and a free end residing externally of said backing member,
  said complemental element being carried intermediate the ends of said flexible member.

6. A jewelry device for removably holding and displaying a selected ornamental flexible sheet member and for detachable securement to a selected substrate, said jewelry device comprising:

(a) a backing member including
  (i) a front side;
  (ii) a rear side; and
  (iii) a forwardly directed contact surface;
(b) a removable member including
  (i) a front surface for receiving said sheet member thereover; and
  (ii) a complemental contact surface opposing said contact surface for receiving a peripheral portion of said sheet member therebetween;
(c) coupling means for detachably affixing said removable member to said backing member and compressively gripping said sheet member between said contact surfaces and further including:

(i) an element of male/female engagement pair carried by said backing member;

(ii) a complemental element of said male/female engagement pair carried by said removable member;

(iii) biasing means normally holding said element and said complemental element in engagement; and (iv) manually manipulative release means for selectively opposing said biasing means and disengaging said element from said complemental element comprising a lever extending from said male/female engagement pair through said backing member having a terminal portion residing in juxtaposition with the rear side of said backing member;

(d) attachment means projecting from the rear side of said backing member for detachably securing said jewelry device to said substrate.

(e) alignment means whereby said removable member is received by said backing member in axial alignment.

7. The jewelry device of claim 6, wherein said alignment means includes:

(a) a socket formed into the front side of said backing member; and (b) a projection extending from said removable member and locationally receivable within said socket.

8. The jewelry device of claim 7, wherein:

(a) said socket includes a generally cylindrical internal surface; and (b) said projection includes an external surface matingly receivable within said internal surface.

* * * * *

UNITED STATES PATENT AND TRADEMARK OFFICE

CERTIFICATE OF CORRECTION

PATENT NO. : 4,899,556

DATED : Feb. 13, 1990

INVENTOR(S) : Donna M. Law

It is certified that error appears in the above-identified patent and that said Letters Patent is hereby corrected as shown below:

On the title page, under item [19], "Ford" should be --Law--; and in item [76], "Donna M. Ford" should be --Donna M. Law--.

Signed and Sealed this

Fifteenth Day of January, 1991

*Attest:*

HARRY F. MANBECK, JR.

*Attesting Officer*

*Commissioner of Patents and Trademarks*